United States Patent [19]

Dahlmann et al.

[11] Patent Number: 4,865,661

[45] Date of Patent: Sep. 12, 1989

[54] PRODUCT OF A HIGH-STRENGTH NITROGEN CONTAINING FULLY AUSTENITIC COBALT STEEL HAVING YIELD STRENGTHS ABOVE 600 N/MM2

[75] Inventors: Peter Dahlmann, Essen; Johannes Jachowski, Duisburg; Paul Pant; Gerald Stein, both of Essen, all of Fed. Rep. of Germany

[73] Assignee: Fried. Krupp GmbH, Essen, Fed. Rep. of Germany

[21] Appl. No.: 264,379

[22] Filed: Oct. 31, 1988

[30] Foreign Application Priority Data

Oct. 31, 1987 [DE] Fed. Rep. of Germany ..... 3736965

[51] Int. Cl.[4] ..... C22C 38/0; C22C 38/30; C22C 38/52

[52] U.S. Cl. ..... 148/325; 148/327; 148/336; 420/36; 420/65; 420/107; 420/128

[58] Field of Search ..... 148/325, 327, 337, 336, 148/136; 420/36, 59, 65, 107, 128

[56] References Cited

U.S. PATENT DOCUMENTS

| | | | |
|---|---|---|---|
| 4,588,440 | 5/1986 | Simoneau | 148/325 |
| 4,610,734 | 9/1986 | Hartwig et al. | 420/65 |

FOREIGN PATENT DOCUMENTS

| | | | |
|---|---|---|---|
| 58224149 | 12/1983 | Japan | 420/36 |
| 1013239 | 12/1965 | United Kingdom | 420/36 |
| 1514934 | 6/1978 | United Kingdom . | |

*Primary Examiner*—Deborah Yee
*Attorney, Agent, or Firm*—Spencer & Frank

[57] ABSTRACT

A high strength austenitic steel having a yield strength above 600 N/mm² at 0.2% permanent strain, containing about 0.5 to 1.5% by weight of nitrogen, about 6 to 12% by weight cobalt, and less than 5% by weight nickel. The steel is treated at about 1050° C. to 1200° C. and then quenched in water.

15 Claims, 1 Drawing Sheet

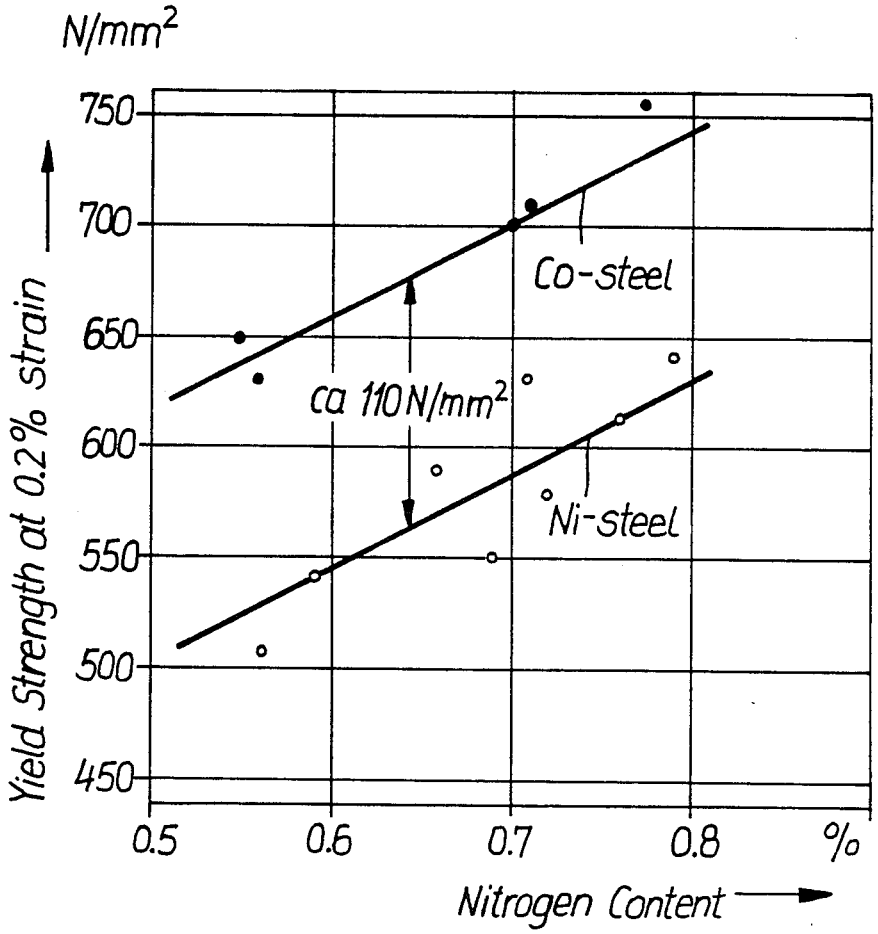
N/mm²
750
700
650
600
550
500
450
Yield Strength at 0.2% strain
Co-steel
ca 110 N/mm²
Ni-steel
0.5
0.6
0.7
0.8
%
Nitrogen Content

PRODUCT OF A HIGH-STRENGTH NITROGEN CONTAINING FULLY AUSTENITIC COBALT STEEL HAVING YIELD STRENGTHS ABOVE 600 N/MM2

FIELD OF THE INVENTION

The present invention relates to high-strength, nitrogen containing cobalt steels.

TECHNOLOGY REVIEW

In recent years, the requirements placed on components made of austenitic chromium-nickel steels have risen considerably, particularly in the energy field and in the chemical industry. It has therefore been a long-standing desire to increase the yield strengths of such steels to more than 600 Newton/mm$^2$ (all yield strengths herein use a permanent strain value of 0.2%).

It is known that nitrogen in highly alloyed austenitic chromium-nickel steels substantially improves the yield strength. However, if such steels are melted under normal pressure, the melt must not receive more nitrogen than corresponds to the nitrogen solubility limit of the respective steel under normal pressure. Otherwise gas bubbles would form in the solidified block. The nitrogen solubility limit is dependent upon the content of certain alloying elements in the steel which increase nitrogen solubility (e.g. chromium, manganese, molybdenum) or reduce it (e.g. nickel).

One of the best known steels in which careful adjustment of the chemical composition permits the introduction of large amounts of nitrogen under normal pressure is the chromium-nickel steel known as Material No. 1.3964 (Steel-Iron List, 7th Edition, pages 88–89). Having a composition of 0.5% carbon, 1% silicon, 6% manganese, 21% chromium, 3.5% molybdenum, 17% nickel, 0.35% nitrogen, and the remainder iron, this steel achieves yield strength values of about 430 N/mm$^2$ after a solution heat treatment at 1100° C. and subsequent quenching in water. Compared thereto, austenitic chromium-nickel steels of this type of alloy but free of nitrogen have yield strength values of about 270 N/mm$^2$.

With the aid of a process disclosed in German Patent No. 2,924,415, a reproducible nitrogen content can be produced in highly alloyed steels in an electroslag remelting process operating under elevated pressure by adding silicon nitride as a source of nitrogen. The nitrogen content of these steels is far above the nitrogen solubility limit under normal pressure. Without noticeable reduction in toughness values, this process permits yield strengths to be raised to values above 600 N/mm$^2$, for example in austenitic steels having chemical compositions similar to that of Steel No. 1.3964, by setting the nitrogen content to greater than 0.75 weight percent. Additionally, the long-term behavior at room temperature and at higher temperatures as well as the corrosion resistance of these steels are improved.

To further increase the yield strength to more than 700 N/mm$^2$, it is necessary to increase the nitrogen content of chromium-nickel steels to more than 0.85 weight percent. However, this requires large quantities of silicon nitride to be introduced into the slag during remelting. From the practice of electroslag remelting it is known that with increasing quantities of alloying additives into the slag, considerable qualitative and economic disadvantages result for the product.

SUMMARY OF THE INVENTION

It is therefore an object of the present invention to provide austenitic chromium-nickel steels which, having a nitrogen content of at least 50% above the nitrogen solubility limit under normal pressure (calculated for 1600° C.), exhibit yield strengths of more than 600N mm$^2$ and whose nitrogen content in the range above the stated minimum content is as low as possible.

This is accomplished by the present invention which provides austenitic chromium-nickel steels whose nitrogen content is at least about 50% above the nitrogen solubility limit under normal pressure (calculated for 1600° C.), which are subjected to a solution heat treatment at about 1050° C. to about 1200° C. to then be quenched in water and which, for a nitrogen content of about 0.5 to about 1.5 weight percent, have a cobalt content of about 6 to about 12 weight percent, provided that the nickel content is lower than about 5 weight percent. Because the alloying element nickel is substituted within the stated limits by the alloying element cobalt, such chromium-nickel steels exhibit significantly higher yield strengths than austenitic chromium-nickel steels free of cobalt in the same heat treatment state and with the same nitrogen content.

BRIEF DESCRIPTION OF THE FIGURE

The sole FIGURE shows the yield strength values as a function of the nitrogen content of the steel for cobalt and nickel steels.

DESCRIPTION OF THE PREFERRED EMBODIMENTS

The subject matter of the invention will now be described in greater detail with reference to two examples. Unless otherwise mentioned, all alloying elements are expressed in weight percent. In connection therewith, Tables 1 and 2 show the following.

Table 1, a comparison of the mechanical properties of a chromium-nickel steel and a chromium-cobalt steel having a nitrogen content greater than 0.5 weight percent;

Table 2, a comparison of the mechanical properties of a chromium-nickel steel and a chromium-cobalt steel having a nitrogen content greater than 0.7 weight percent.

The steels listed in Tables 1 and 2 were produced using the pressure electroslag remelting process. During remelting, silicon nitride was continuously added to the steels at elevated pressure in order to obtain the desired nitrogen content. The steels were then subjected to a solution heat treatment at 1150° C. and then quenched in water.

In the chromium-nickel steel (identified as Ni steel) listed in Table 1, the nitrogen solubility limit at 1 bar and 1600° C. is 0.27 weight percent. By electroslag remelting under elevated pressure, a nitrogen content of 0.56 weight percent can be achieved. Thus, the nitrogen content of this steel is more than 50% above the nitrogen solubility limit. The yield strength of the steel is 510 N/mm$^2$. In the chromium-cobalt steel containing only 0.43 weight percent nickel (identified as Co steel) produced under otherwise identical conditions and having the same nitrogen content (0.56 weight percent), whose nitrogen solubility limit (0.22 weight percent at 1 bar and 1600° C.) has also been exceeded by more than 50%, the yield strength is 630 N/mm$^2$. Thus, it is more than 100 N/mm² higher than that of the comparable chromium-nickel steel.

In the chromium-nickel steel (Ni steel) listed in Table 2, the nitrogen content is 0.79 weight percent. The nitrogen solubility limit of this steel is 0.33 weight percent (1 bar and 1600° C.) and has thus been exceeded by more than 50%. The steel has a yield strength of 640 N/mm². In contrast thereto, a chromium-cobalt (Co steel) steel having a nickel content of 0.52 weight percent and approximately the same nitrogen content (0.78 weight percent), in which the nitrogen solubility limit (0.24 weight percent at 1 bar and 1600° C.) has also been exceeded by more than 50%, has a yield strength of 755 N/mm². In this steel as well, the yield strength was raised by about 100 N/mm² by substituting the alloying element nickel with cobalt.

The FIGURE shows yield strengths for various cobalt and nickel steels as a function of the nitrogen content of the steel. This overview, and also the examples, indicate that the cobalt-containing steels have yield strengths which are higher by more than 100 N/mm², with approximately the same nitrogen content, than the nickel-containing steels free of cobalt.

The nitrogen solubility of a steel under normal pressure, $[\%N]_{Fe}^{X,Y\cdots}$ is defined as the nitrogen content of the steel calculated according to the formula $$[\%N]_{Fe}^{X,Y\cdots} = \frac{[\%N]_{Fe}}{f_N^{X,Y\cdots}}$$

from the nitrogen solubility of pure iron ([%N]Fe) and the interaction coefficient ($f_N^{X,Y\cdots}$) of the alloy, where X, Y, etc., are various alloying substances. The calculation is made with data determined experimentally at a temperature of 1600° C. and a pressure of 1 bar. These values were obtained from the data collection of Gmelin-Durrer (Volume 5, pages 159a/160a, published by Springer Verlag, Berlin, Heidelberg, New York, 1978).

Advantageously, the steel according to the invention may contain about 0.01 to 0.1 weight percent carbon; about 0.5 to 2 weight percent silicon; about 0.5 to 8 weight percent manganese; about 15 to 25 weight percent chromium; about 0.5 to 5 weight percent molybdenum; 0 to about 0.5 weight percent niobium; 0 to about 0.5 weight percent vanadium; 0 to about 3 weight percent tungsten; 0 to about 0.2 weight percent cerium; 0 to about 0.1 weight percent boron; 0 to about 0.5 weight percent tantalum; 0 to about 0.5 weight percent titanium.

The present disclosure relates to the subject matter disclosed in our patent application No. P 37 36 965.2 filed in the Patent Office of the Federal Republic of Germany on Oct. 31st, 1987, the entire specification of which is incorporated herein by reference.

It will be understood that the above description of the present invention is susceptible to various modifications, changes and adaptations, and the same are intended to be comprehended within the meaning and range of equivalents of the appended claims.

TABLE 1

| | chemical composition in % | | | | | | | | | nitrogen solubility limit % at 1 bar and 1600° C. | mechanical properties* | | | | | |
|---|---|---|---|---|---|---|---|---|---|---|---|---|---|---|---|---|
| | C | So | Mn | Cr | Ni | Co | Mo | Nb | N | | $R_{p0.2}$ N/mm² | $R_m$ N/mm² | $A_5$ % | Z % | $a_K$ J | e-modulus N/mm² · $10^5$ |
| Ni steel | 0.05 | 0.70 | 3.37 | 20.40 | 15.70 | — | 3.06 | 0.15 | 0.56 | 0.27 | 510 | 910 | 52 | 70 | 180 | 1.8 |
| Co steel | 0.06 | 1.05 | 2.62 | 17.95 | 0.43 | 11.30 | 3.70 | 0.18 | 0.56 | 0.22 | 630 | 1050 | 51 | 70 | 150 | 2.16 |

Heat treatment: 1150° C./$H_2O$
*$R_{p0.2}$ is yield strength at 0.2% permanent strain;
$R_m$ is tensile strength;
$A_5$ is elongation at rupture;
Z is contraction; and
$a_K$ is impact energy (Charpy V)

TABLE 2

| | chemical composition in % | | | | | | | | | nitrogen solubility limit % at 1 bar and 1600° C. | mechanical properties* | | | | | |
|---|---|---|---|---|---|---|---|---|---|---|---|---|---|---|---|---|
| | C | So | Mn | Cr | Ni | Co | Mo | Nb | N | | $R_{p0.2}$ N/mm² | $R_m$ N/mm² | $A_5$ % | Z % | $a_K$ J | e-modulus N/mm² · $10^5$ |
| Ni steel | 0.05 | 1.75 | 4.75 | 20.80 | 7.20 | — | 2.8 | 0.27 | 0.79 | 0.33 | 640 | 1070 | 42 | 72 | 114 | 2.01 |
| Co steel | 0.03 | 1.82 | 3.05 | 19.02 | 0.52 | 7.5 | 2.5 | 0.12 | 0.78 | 0.24 | 755 | 1180 | 39 | 65 | 110 | 2.18 |

Heat treatment: 1150° C./$H_2O$

What is claimed is:

1. A product of a high-strength austenitic cobalt steel having a nitrogen content of at least 50% above the nitrogen solubility limit of the steel at normal pressure, and a yield strength of more than 600 N/mm², said steel (being) having been subjected to a solution heat treatment at about 1050° C. to about 1200° C. with subsequent quenching in water, said steel compromising:

nitrogen in an amount of about 0.5 to about 1.5 weight percent;

cobalt in an amount of about 6 to about 12 weight percent; and nickel in an amount which is less than about 5 weight percent.

2. A steel as defined in claim 1, wherein the amount of nickel is between about 0.2 percent and about 3 weight percent.

3. A steel as defined in claim 1, further comprising about 0.01 to 0.1 weight percent carbon.

4. A steel as defined in claim 1, further comprising about 0.5 to 2 weight percent silicon.

5. A steel as defined in claim 1, further comprising about 0.5 to 8 weight percent manganese.

6. A steel as defined in claim 1, further comprising about 15 to 25 weight percent chromium.

7. A steel as defined in claim 1, further comprising about 0.5 to 5 weight percent molybdenum.

8. A steel as defined in claim 1, further comprising up to about 0.5 weight percent niobium.

9. A steel as defined in claim 1, further comprising up to about 0.5 weight percent vanadium.

10. A steel as defined in claim 1, further comprising up to about 3 weight percent tungsten.

11. A steel as defined in claim 1, further comprising up to about 0.2 weight percent cerium.

12. A steel as defined in claim 1, further comprising up to about 0.1 weight percent boron.

13. A steel as defined in claim 1, further comprising up to about 0.5 weight percent tantalum.

14. A steel as defined in claim 1, further comprising up to about 0.5 weight percent titanium.

15. A steel as defined in claim 1, further comprising
about 0.01 to 0.1 weight percent carbon;
about 0.5 to 2 weight percent silicon;
about 0.5 to 8 weight percent manganese;
about 15 to 25 weight percent chromium;
about 0.5 to 5 weight percent molybdenum;
0 to about 0.5 weight percent niobium;
0 to about 0.5 weight percent vanadium;
0 to about 3 weight percent tungsten;
0 to about 0.2 weight percent cerium;
0 to about 0.1 weight percent boron;
0 to about 0.5 weight percent tantalum; and
0 to about 0.5 weight percent titanium.

* * * * *